US006994132B2

(12) United States Patent
Antrobus

(10) Patent No.: US 6,994,132 B2
(45) Date of Patent: Feb. 7, 2006

(54) CONVERTIBLE CARRYING ASSEMBLY

(76) Inventor: Alison Antrobus, 6770 Indian Creek Dr., Tower Suite S, TS-S, Miami Beach, FL (US) 33141

( * ) Notice: Subject to any disclaimer, the term of this patent is extended or adjusted under 35 U.S.C. 154(b) by 159 days.

(21) Appl. No.: 10/708,092

(22) Filed: Feb. 7, 2004

(65) Prior Publication Data

US 2005/0173034 A1 Aug. 11, 2005

(51) Int. Cl.
*A45C 13/30* (2006.01)
*A45C 1/02* (2006.01)
*A45C 3/06* (2006.01)

(52) U.S. Cl. ..... 150/107; 150/103; 150/104; 150/113; 190/1; 190/108; 190/110; 383/4; 383/37

(58) Field of Classification Search ..... 150/103–107, 150/111–113.154; 190/1, 26, 107, 108, 110; 383/4, 37
See application file for complete search history.

(56) References Cited

U.S. PATENT DOCUMENTS 685,149 A * 10/1901 Gilbert ..... 165/54
1,206,276 A * 11/1916 Wallach ..... 190/109
1,996,653 A * 4/1935 Rodgers ..... 206/216
2,118,323 A * 5/1938 Murphy ..... 312/244
2,463,993 A * 3/1949 Meyers ..... 150/113
2,555,778 A * 6/1951 Blume ..... 190/110
2,570,851 A * 10/1951 Peyser ..... 150/104
2,672,903 A * 3/1954 Machinist ..... 150/111
D177,591 S * 5/1956 Robinson ..... D3/203.7
2,801,666 A * 8/1957 Steele ..... 150/113
3,186,529 A * 6/1965 Gilbert ..... 312/244
3,335,775 A * 8/1967 Adams ..... 150/113
3,726,329 A * 4/1973 Dean ..... 150/111
3,955,609 A 5/1976 Siegel
3,976,113 A * 8/1976 Kim ..... 383/4
4,112,991 A 9/1978 Barbarsi (Continued)

FOREIGN PATENT DOCUMENTS

JP 405130910 A * 5/1993

*Primary Examiner*—Sue A. Weaver
(74) *Attorney, Agent, or Firm*—Akerman Senterfitt; Michael C. Cesarano

(57) ABSTRACT

A convertible carrying assembly has separable upper and lower sections, and a removable lower outer covering. The upper section consists of a small handbag with external fasteners for holding the lower outer covering and lower section. When disconnected, the upper section may be used as a handbag. The lower section includes a removable drawer-style organizer. Side panels formed from the outer covering may be unzipped to give access to the drawers in the organizer. If desired, the organizer may be removed for stand-alone use. The outer covering may be used as a stand-alone bag, or may be unzipped to form a flat surface that can be further used or folded for a variety of functions.

17 Claims, 5 Drawing Sheets

U.S. PATENT DOCUMENTS 4,126,213 A * 11/1978 McDonald ..... 190/18 A
4,498,590 A * 2/1985 Burdick ..... 206/581
4,685,559 A * 8/1987 Titus ..... 206/38
4,792,024 A * 12/1988 Morton et al. ..... 190/1
4,856,570 A * 8/1989 Rushing et al. ..... 150/107
5,140,833 A * 8/1992 Whalen ..... 62/457.7
5,209,279 A * 5/1993 Wilson ..... 150/111
5,641,199 A * 6/1997 Bond-Madsen ..... 297/229
5,660,476 A * 8/1997 DeCoster ..... 383/29
5,873,504 A * 2/1999 Farmer ..... 224/576
5,911,262 A 6/1999 Steinhart
6,076,485 A * 6/2000 Peeples et al. ..... 119/497
6,637,484 B1 10/2003 Kraft

* cited by examiner

CONVERTIBLE CARRYING ASSEMBLY

BACKGROUND OF INVENTION

This invention pertains to a convertible carrying assembly that may be used as a carrying bag such as an over-the-shoulder handbag, a totebag, a backpack, or the like, having multiple components. The convertible carrying assembly of this invention will be referred to herein as a "carrying bag," although it will be understood that this term refers to carrying assemblies of varying sizes and styles that are suitable to a wide variety of uses, including overnight bags, women"s purses, wheeled airplane carry-ons, gym bags, personal carryalls in general, any carrying bag combination for personal use. If desired, an internal organizer having drawers may be integrated as an internal component of the carrying bag. The organizer may also be removed from the carrying bag to become a stand-alone desktop organizer or other drawer-style container. An inner pouch is convertible to a smaller carrying bag or purse; and the removable external covering may be converted to a variety of uses including a clutch handbag, an infant changing pad, a pet blanket, a garment bag, or other, similar articles.

Carrying bags are traditionally used to carry and keep within arm's reach a wide range of useful tools and items that may be needed or used numerous times during the course of a day. Typical items commonly carried in a carrying bag may include clothing, shoes, cosmetics and beauty aids, combs and hairbrushes, automobile and house keys, travel or airline tickets, pens and notepads, cellular telephone, checkbook, personal data assistant (PDA), wallet, money, credit cards, and other useful items. One problem frequently associated with carrying so many items of diverse sizes and shapes is that it becomes difficult to easily or quickly find a particular needed item within the single storage enclosure that is typical of most carrying bags. Not only must a person carrying such a bag on a shoulder go through difficult and sometimes painful contortions to view or reach objects in the bag, but the items usually are layered atop one another, and a desired item may be hidden underneath others. Although carrying bags having separators, pockets, and pouches for various items have found some popularity, it may be difficult for a person using such a bag to remember in which section, pocket, or pouch a particular needed item may have been placed. In that situation, the search through a single storage enclosure has been replaced by multiple searches through each pocket and pouch until the particular needed item is located. In either case, it is inconvenient and time-consuming for a person using a carrying bag to search through the bag every time a particular item is required. What is needed is a carrying bag organizer that is convenient to use, and that intuitively suggests the location of particular items that are carried in the bag.

SUMMARY OF INVENTION

The present invention is a carrying bag having separable upper, and lower sections, and a removable lower outer covering. The upper section consists of a small handbag of a traditional style on the exterior side surfaces of which are located fasteners for holding the lower outer covering and lower section. The lower section includes a removable drawer-style organizer. The side panels, the front and back panels, and the base of the outer covering are made of a flexible material that is formed in the shape of a box that is open at the top. The vertical sides of the box are joined at their edges by zippers or some other suitable linear fastener such as Velcro®. Although any suitable fastener may be used to connect the panels while also allowing one or more panels to be disconnected to fall open, the term "zipper" shall be used herein to refer to any generic fastener. When unzipped, the outer covering lies flat, and is able to be formed or folded into another useful object.

The side panels of the outer covering have fasteners near their upper edges that mate with the fasteners of the upper section. When fastened and zipped, the outer covering forms a box immediately below the upper section. The organizer fits snugly within the box formed by the outer covering, and has one or more tiers of drawers within a rigid frame. The drawers are of varying heights, depths, and widths, and a single drawer may extend the entire width and length of the lower section, or multiple drawers may fit side-by-side across the width of the lower section or back to back across the length of the section. When an item in a drawer, such as a checkbook, airline ticket, or automobile key, is needed, a front or side panel may be unzipped to fall open, exposing the drawer which may then be withdrawn to allow extraction of the item. When the drawer is closed, the panel may be rezipped, and the handbag then takes on its normal shape. Flat items such as checkbooks, tickets, or notepads, may be carried within the wider drawers, while other items such as pens, pencils, lipsticks, or penknives, may be carried in narrower drawers. When it is desired to remove the drawer-organizer from the handbag, it may be removed and used as a stand alone desktop organizer.

The upper section is a small, traditional purse having a single large opening and possibly also having sections, pockets, or pouches. When a smaller handbag is desired, the lower section may be removed and the upper section used as the sole handbag.

The outer surface of the lower section of the carrying bag is entirely removable from the upper section and from the drawer-organizer. It consists of a flexible base, front and real (rear?) panels, and side panels. It may be fully unfolded to form a pad or blanket in the form of a broad cross, or one or more panels may be folded and attached in various ways to form other useful objects, such as, for example, a clutch handbag, an infant's changing pad, a garment bag, a writing pad, a mat to sit on, or a folder for holding files.

The carrying bag can be fitted with wheels and a handle for rolling, rather than carrying. Other embodiments include configuring the carrying bag to fit underneath an airline seat, and to have the drawers in the organizer open toward the passenger when the front flap is lowered.

It is an object of this invention to provide a carrying bag that may be carried over the shoulder while providing access to the lower section by opening a panel. It is a further object of the invention to provide a rigid drawer-like container for organizing and carrying items in a carrying bag. It is yet a further object of the invention to provide a carrying bag that may be disassembled into components to form a smaller handbag and a stand alone drawer-style organizer. It is another object of the invention to provide an outer covering that can be removed from the carrying bag, unfolded, and used as a pad, garment bag, or can be refolded and used for other purposes.

DETAILED DESCRIPTION

Figure 1:
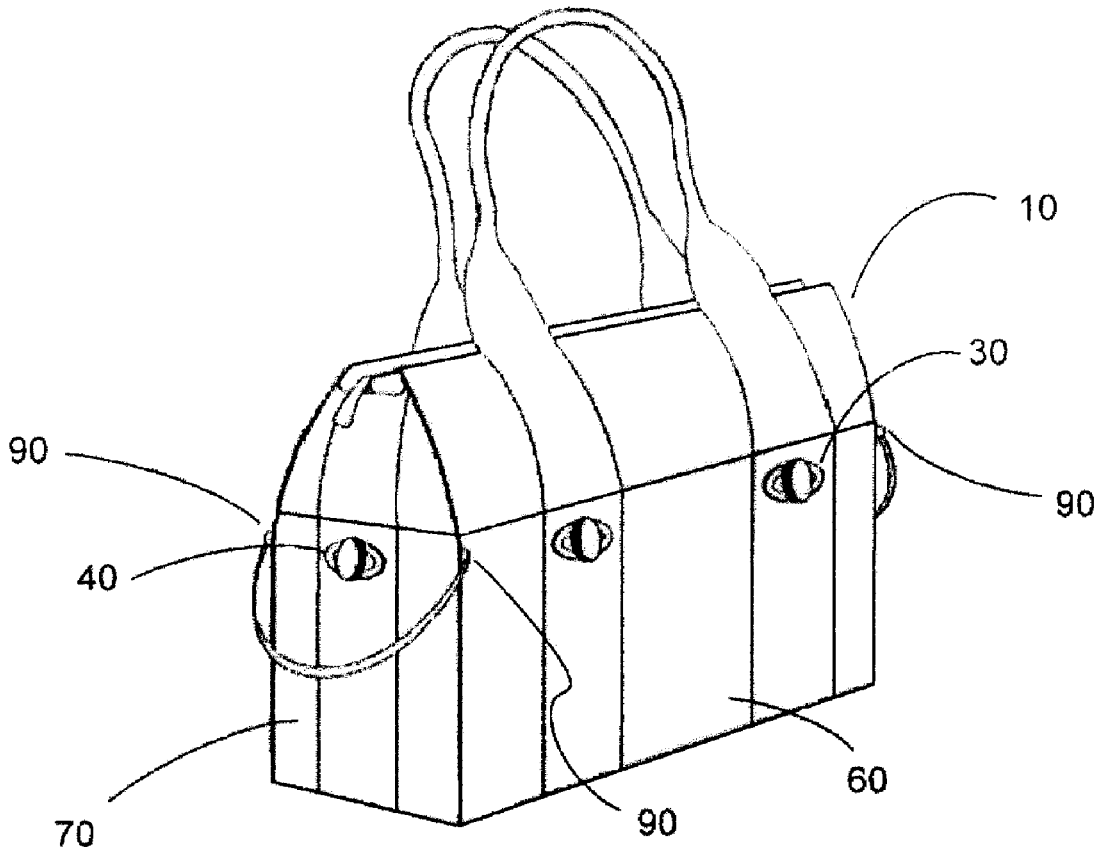
FIG. 1 is a perspective view of the carrying bag of this invention with all components closed.

As shown in FIG. 1, the carrying bag of this invention has conventional handles, an upper section 10, and a lower section. The lower section has a right side flap 60, and a rear flap 70. Left and front side flaps are not visible in FIG. 1, but correspond as components opposite to the right side flap 60 and the rear flap 70. The flaps have vertical linear fasteners (which will be referred to herein as "zippers") 90 at the corners where they meet. For convenience, opposing zippers on the front and rear flaps are operated together with a lanyard that connects them and that permits simultaneous raising or lowering of the zippers to permit movement of the flap. Side twist fasteners 30 interlock with grommets in the side flaps to secure the side flaps 60 to the upper component 10. Although twist fasteners and grommets are depicted in the drawing, it is of course possible that other interlocking fasteners, such as snaps, buttons, magnetic interfaces, and the like, may be used for the upper section fasteners and the corresponding lower section fasteners. Accordingly, the terms "twist fastener" and "grommet" shall refer to the component parts of a suitable fastening mechanism on the upper and lower section that interlock together. Front and rear flaps 70 are secured by twist fasteners and grommets 40 in a like manner.

Figure 2:
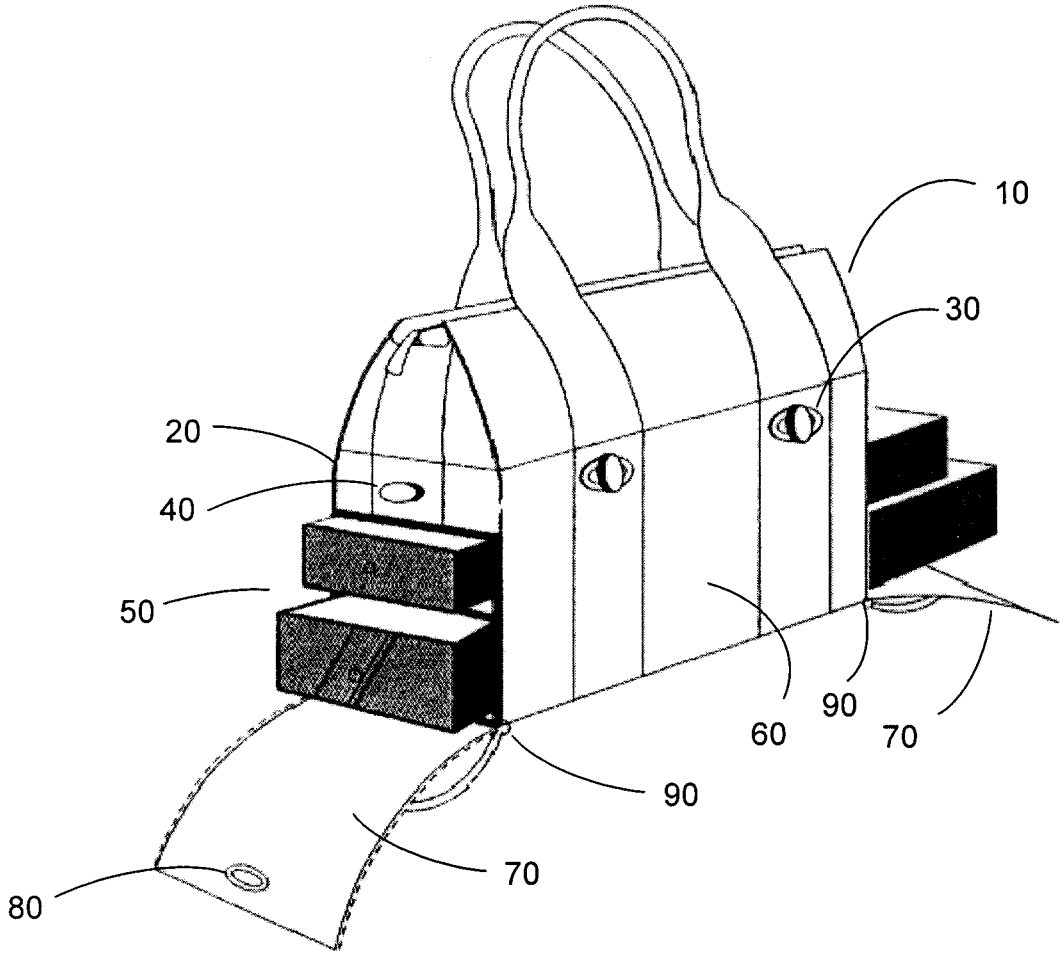
FIG. 2 is a perspective view of the carrying bag of this invention showing the flaps open at either end and one configuration for drawers.

FIG. 2 shows the carrying bag of this invention with front and rear flaps 70 lowered. The front and rear flaps have been disconnected from the upper component 10 by twist fastener 40 to coincide with the opening formed by grommet 80. With the front or rear flap lowered, drawers 50 from the organizer are exposed and may be opened for access to the contents. Zippers 90 have been lowered to permit the downward lowering of front and rear flaps 70. In normal practice, it may be most convenient that only a single flap will be lowered at one time to permit access to the organizer from one side only. However, it would be possible for more than one flap to be opened at the same time, and this configuration is contemplated in the invention.

Figure 3:
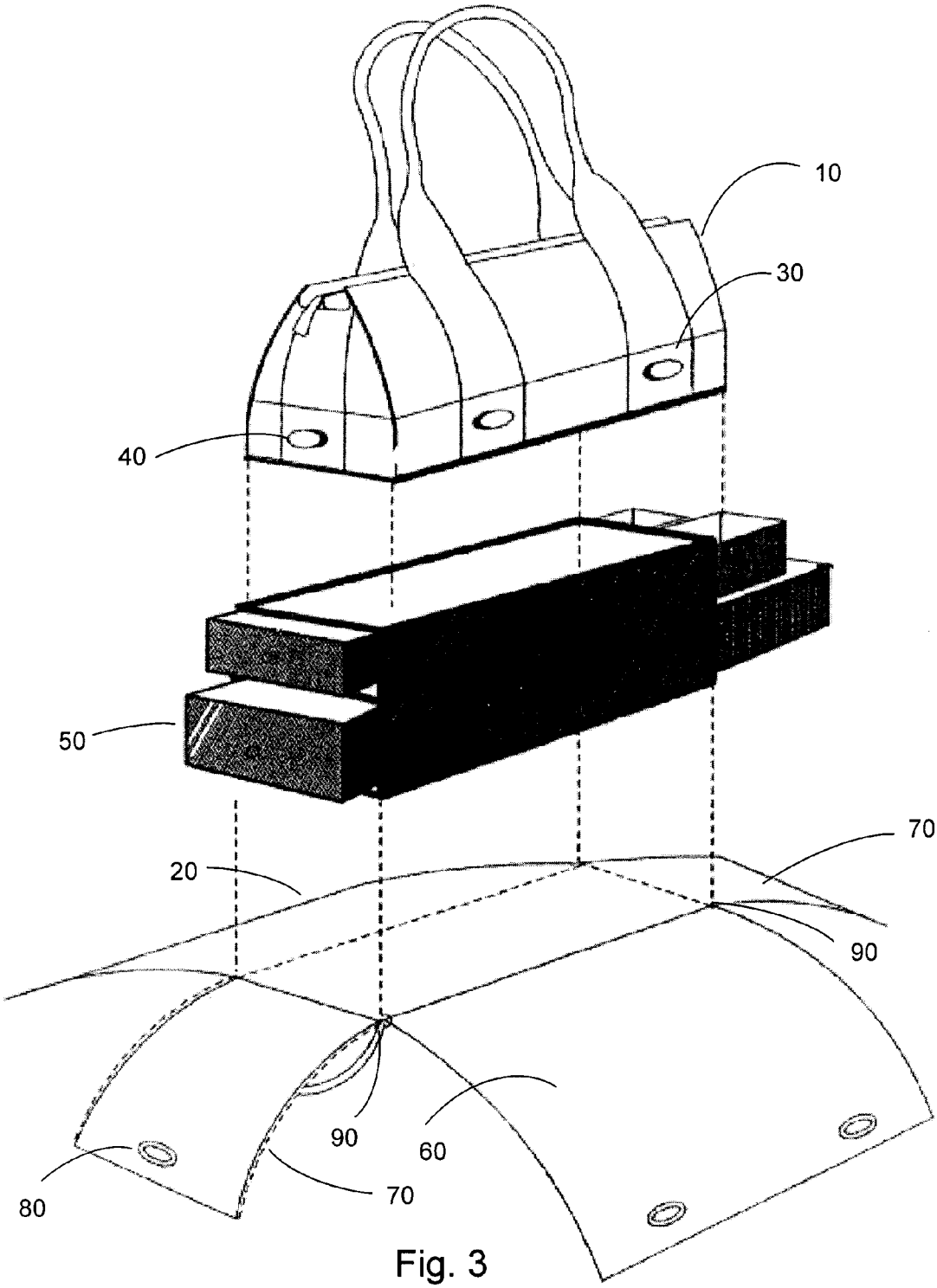
FIG. 3 is an exploded view of the separate components of the carrying bag that shows their relative positions.

In FIG. 3, a view of all removable components of the carrying bag of this invention may be seen. The outer covering consists of right side flap 60, front and rear flaps 70, left side flap 20, and a base. Zippers 90 are at their extreme unzipped positions. The organizer may be removed from the carrying bag and placed on a surface without removing the contents of the drawers 50. As such, it may be stored in a hotel room safe while traveling, or may be placed on a desk or table top where its contents are easily accessible. Upper component 10 is a conventional hand-bag having fasteners 30 and 40 as ornamentation. The outer covering is suitable for any purpose in which a pad or protective layer is needed, such as for a diaper changing table, a cushioned seating pad, or a surface to insulate objects on the pad from the ground. The outer covering may be padded or quilted, and can be fabricated from any combination of fabrics and plastics to be suitable for any desired purpose.

Figure 4:
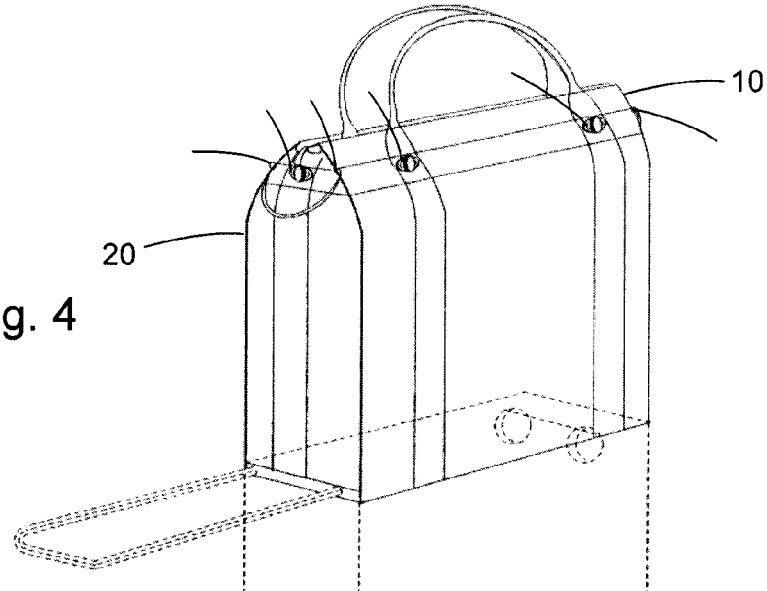
FIG. 4 depicts an embodiment of the invention having wheels and a front handle.

FIG. 4 shows an embodiment of a larger carrying bag having a handle and wheels for rolling the bag. A large organizer holds drawers that may be individually larger than those in smaller embodiments, or that may comprise more tiers of drawers than will fit in smaller embodiments. The drawers may be arranged for opening toward the front, rear, side, or any combination.

Figure 5:
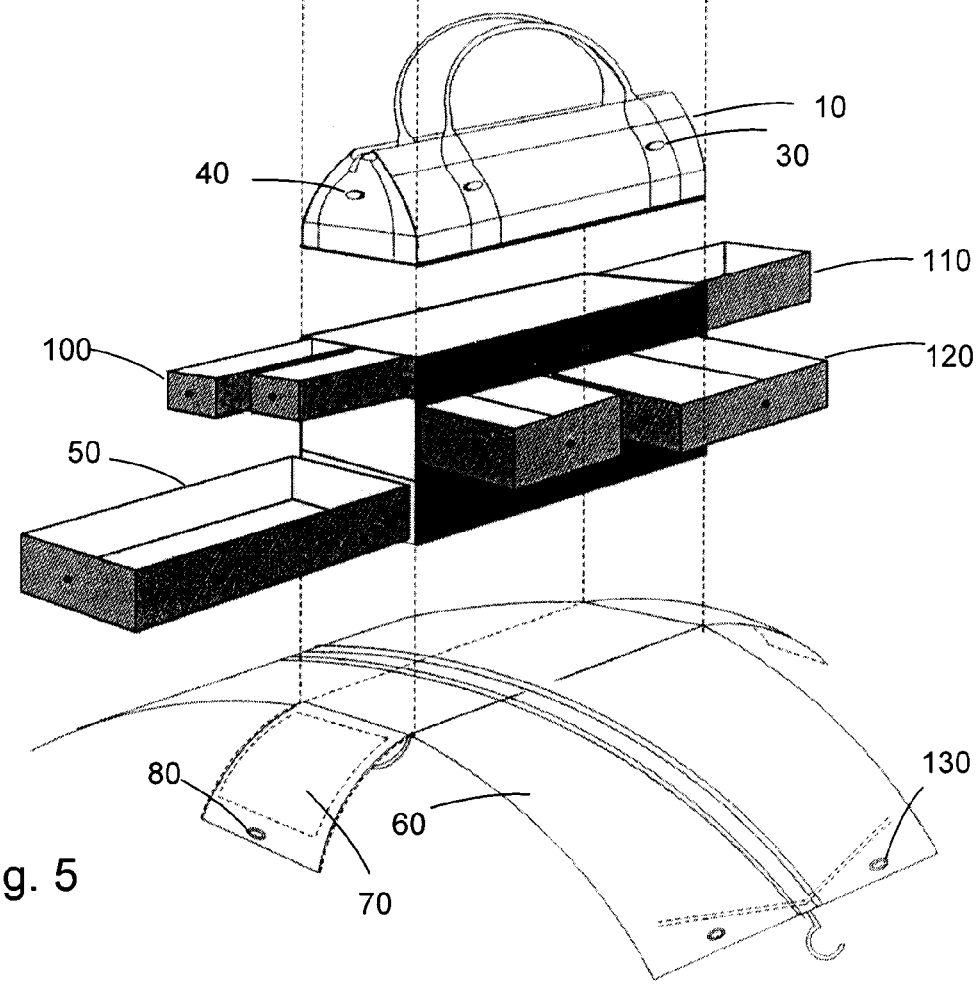
FIG. 5 is an exploded view showing other embodiments of the organizer and other components.

FIG. 5 shows drawers in a larger organizer in which wide flat drawers 50, 110 open to the front and rear, narrower drawers 100 open toward the rear, and very wide drawers 120 open to the side. As shown, drawers 110 and 100 fit back to back when closed, and have a combined depth of slightly less than the length of the organizer. FIG. 5 also shows a configuration of the outer covering to form a garment bag. While the garment bag will have a built-in hook for hanging, it is possible that grommets 130 may also or alternatively be used to suspend the garmet bag.

Figure 6A:
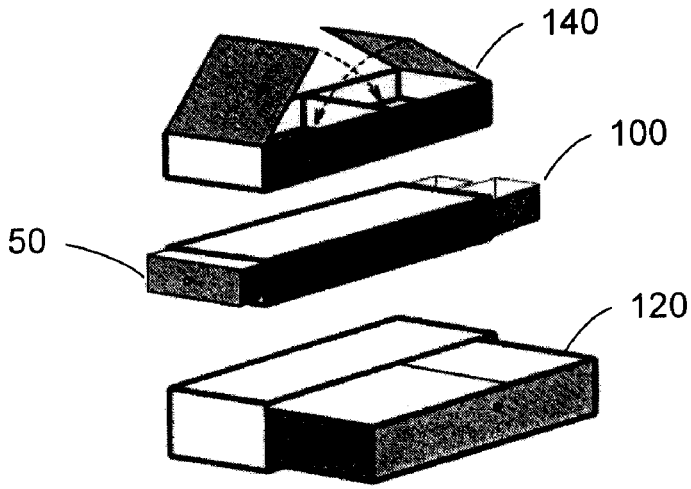
FIGS. 6*a* and 6*b* depict various drawer styles and configurations for the organizer.
Figure 6B:
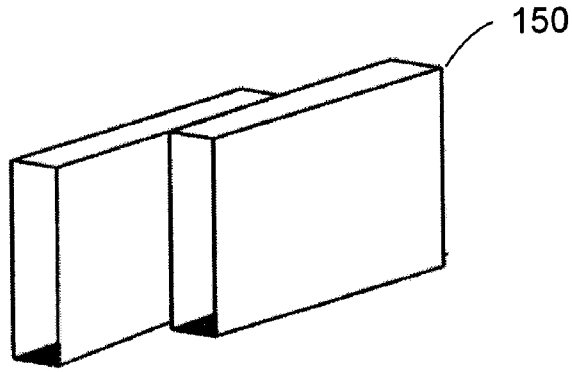

FIG. 6*a* shows other configurations for horizontally-mounted drawers, including a drawer having closing and securing flaps 140, a drawer tier 100 holding both a flat drawer 50 and two narrower drawers 100 in a back to back configuration, and a single, flat drawer 120 opening toward the side of the organizer. FIG. 6*b* depicts a configuration in which drawers may be vertically oriented.

Figure 7:
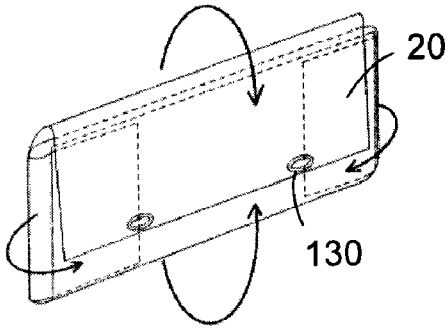
FIG. 7 demonstrates one embodiment of the folded outer covering for this invention.
Figure 8:
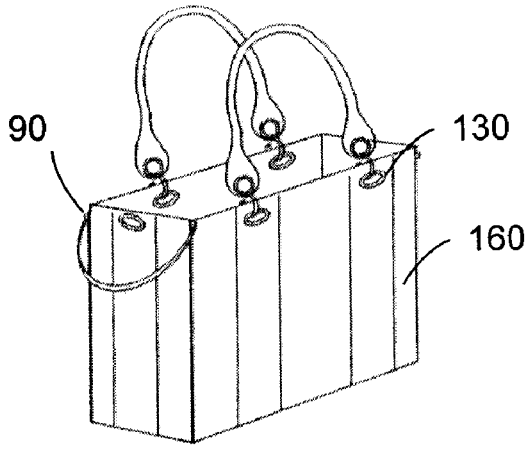
FIG. 8 shows another embodiment in which releasable handles are used solely with the outer covering.

The outer covering can be folded to create a clutch handbag, as depicted in FIG. 7. Such a configuration can be easily maintained through the use of velcro, snaps, or some other suitable fastening apparatus. If desired, the outer covering can be used without the organizer or the upper component to form a beach bag or similar carrying bag 160. In this configuration, zippers 90 are fully zipped, and the handles have been removed from the upper component and affixed to the outer covering using grommets 130. Alternatively, accessory handles may be separately available for attaching to the lower section to form a beach bag or similar carrying bag 60.

It will be apparent to those of skill in the art that the embodiments and configurations depicted and described herein are exemplary, and that other embodiments and configurations may be made and used without departing from the spirit or essence of the invention whose scope is limited only through the following claims.

I claim:

1. A convertible carrying assembly comprising:

a handle;

an upper section, said upper section comprising a carrying bag having an interior volume, a top opening, and outer fasteners;

a lower section being releasably attached to said upper section, said lower section comprising an interior volume and an outer covering, said outer covering having a base and vertical sidewalls, at least a portion of one of said sidewalls forming a flap that can be lowered to provide access to said interior volume in said lower section, the side edges of said flap being releasably attached to the edges of adjacent sidewalls when said flap is closed, the upper portions of said sidewalls of said lower section having fasteners that releasably attach to said outer fasteners of said upper section.

2. A convertible carrying assembly as claimed in claim 1, said sidewalls comprising a plurality of flaps, each said flap being releasably attached to an adjacent flap along their corresponding edges, the upper portion of each said flap being releasably attached to one or more of said outer fasteners of said upper section.

3. A convertible carrying assembly as claimed in claim 2, said lower section further comprising an organizer situated within said interior volume, said organizer having one or more drawers for retaining items to be carried, said one or more drawers being at least partially extractible from said organizer when said flap is lowered to expose said one or more drawers.

4. A convertible carrying assembly as claimed in claim 3, said organizer having a plurality of tiers wherein drawers on a first tier are extractible along a longitudinal axis of said organizer and drawers on a second tier are extractible along an axis that is orthogonal to said longitudinal axis, each said flap in said plurality of flaps being separately lowerable to permit the extraction of orthagonally situated drawers in said first and second tiers.

5. A convertible carrying assembly as claimed in claim 3, said organizer being removable from said lower section while retaining items to be carried in said one or more drawers.

6. A convertible carrying assembly as claimed in claim 2, said releasable attachments between adjacent flaps extending vertically from said base of said outer covering to the upper portion of said flaps whereby, when said releasable attachments are fully released and said upper portions of said sidewalls are fully released from said outer fasteners of said upper section, said outer covering will open to form a flat surface.

7. A convertible carrying assembly as claimed in claim 6, said outer covering having an inner surface and an outer surface, and the space between said inner and outer surfaces containing padding.

8. A convertible carrying assembly as claimed in claim 6, said outer covering having an inner surface and an outer surface, at least one of said surfaces being a waterproof material.

9. A convertible carrying assembly as claimed in claim 6, said outer covering having an inner surface and an outer surface, said inner and outer surfaces forming a garment bag.

10. A convertible carrying assembly as claimed in claim 6, said outer covering being foldable to form a clutch handbag.

11. A convertible carrying assembly as claimed in claim 1 said handle further comprising one or more handles that fit over a shoulder.

12. A convertible carrying assembly as claimed in claim 11 wherein said one or more handles are releasably attached to said upper section.

13. A convertible carrying assembly as claimed in claim 11 wherein said lower section is releasable from said upper section and, when released, one or more handles are attached to said lower section.

14. A convertible carrying assembly comprising:

an upper carrying bag, a lower carrying bag, and an organizer having drawers, said upper carrying bag having a closable top opening, a handle, and fasteners upon the lower portion of the outer surface of said upper carrying bag, said lower carrying bag having a base and a plurality of vertical sidewalls, the upper portion of each said sidewall having one or more fasteners that interface with said fasteners upon said upper carrying bag to support said lower carrying bag beneath said upper carrying bag, each said sidewall being attached to adjacent sidewalls along adjacent vertical edges, said edge attachments for each sidewall being progressively releasable from an uppermost attached position to a lowermost released position, whereby when said fastener for said sidewall is detached from said fastener on said upper carrying bag, said side-wall lowers to form an openable flap, said organizer being situated such that one or more drawers within said organizer may be extrated through the opening formed by said openable flap.

15. The convertible carrying assembly of claim 14 wherein said upper carrying bag can be fully released from said lower carrying bag to be a separate handbag.

16. The convertible carrying assembly of claim 14 wherein said lower carrying bag can be fully released from said upper carrying bag to be a separate carrying bag.

17. The convertible carrying assembly of claim 14 wherein said organizer having drawers is removable from said assembly to be a separate organizer without having to extract said drawers or remove items from said drawers.

* * * * *